US008081046B2

(12) United States Patent
Mahon et al.

(10) Patent No.: US 8,081,046 B2
(45) Date of Patent: Dec. 20, 2011

(54) ORTHO-MODE TRANSDUCER WITH OPPOSING BRANCH WAVEGUIDES

(75) Inventors: John P. Mahon, Thousand Oaks, CA (US); Cynthia P. Espino, Carlsbad, CA (US)

(73) Assignee: Optim Microwave, Inc., Camarillo, CA (US)

( * ) Notice: Subject to any disclaimer, the term of this patent is extended or adjusted under 35 U.S.C. 154(b) by 0 days.

(21) Appl. No.: 11/684,570

(22) Filed: Mar. 9, 2007

(65) Prior Publication Data

US 2007/0210882 A1 Sep. 13, 2007

Related U.S. Application Data

(60) Provisional application No. 60/781,232, filed on Mar. 10, 2006.

(51) Int. Cl.
*H01P 1/161* (2006.01)

(52) U.S. Cl. ..... 333/125; 333/21 A

(58) Field of Classification Search ..... 333/21 A, 333/125, 137

See application file for complete search history.

(56) References Cited

U.S. PATENT DOCUMENTS

| | | | | |
|---|---|---|---|---|
| 3,201,717 | A | 8/1965 | Grosbois et al. | |
| 3,758,882 | A * | 9/1973 | Morz | 333/21 A |
| 3,932,822 | A * | 1/1976 | Salzberg | 333/125 |
| 4,849,720 | A * | 7/1989 | Call | 333/125 |
| 5,392,008 | A | 2/1995 | Wong | |
| 6,087,908 | A | 7/2000 | Haller | |
| 6,225,875 | B1 | 5/2001 | Kich | |
| 6,496,084 | B1 | 12/2002 | Monte et al. | |
| 6,768,395 | B1 * | 7/2004 | Speldrich et al. | 333/137 |
| 6,842,085 | B2 | 1/2005 | Chen et al. | |
| 6,904,394 | B2 * | 6/2005 | Jaffrey | 703/6 |
| 7,019,603 | B2 | 3/2006 | Yoneda et al. | |
| 7,330,088 | B2 | 2/2008 | Aramaki et al. | |
| 2004/0032305 | A1 * | 2/2004 | Bohnet | 333/21 A |
| 2004/0160292 | A1 * | 8/2004 | Chen et al. | 333/125 |

OTHER PUBLICATIONS

Eric S. Key, General Cylinder (C), Dec. 30, 1999.*

Perov, A.O., et al., Orthomode Transducers with a Common Circular Waveguide, Journal of Communications Technology and Electronics, 2007, vol. 52 No. 6 pp, 626-632.

Boifot, Anton M., Classification of Ortho-Mode Transducers, European Transactions on Tellecommunications, Sep. 1991, vol. 2 No. 5, pp. 503-510.

* cited by examiner

*Primary Examiner* — Benny Lee
*Assistant Examiner* — Gerald Stevens
(74) *Attorney, Agent, or Firm* — SoCal IP Law Group LLP; Mark A. Goldstein; John E. Gunther

(57) ABSTRACT

There is disclosed an ortho-mode transducer fabricated as a single piece. The ortho-mode transducer may include a first surface having an aperture defining a common port, a second surface having an aperture defining a vertical port, and a third surface having an aperture defining a horizontal port. The second and third surfaces may be essentially parallel and normal to the first surface. A common waveguide may coupled to the common port, the common waveguide supporting orthogonal vertical and horizontal modes. A vertical branching waveguide may couple the vertical mode between the vertical port and the common waveguide while rejecting the horizontal mode. A horizontal branching waveguide may couple the horizontal mode between the horizontal port and the common waveguide while rejecting the vertical mode.

20 Claims, 7 Drawing Sheets

ORTHO-MODE TRANSDUCER WITH OPPOSING BRANCH WAVEGUIDES

RELATED APPLICATION INFORMATION

This patent claims benefit of the filing date of provisional patent application Ser. No. 60/781,232, filed Mar. 10, 2006, which is incorporated herein by reference.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to waveguide devices that support two orthogonal modes. Specifically, this disclosure relates to ortho-mode transducers.

2. Description of the Related Art

An ortho-mode transducer (OMT) is a three-port waveguide device having a common waveguide coupled to two branching waveguides. Within this description, the term "port" refers generally to an interface between devices or between a device and free space. A port may include an interfacial surface, an aperture in the interfacial surface to allow microwave radiation to enter or exit a device, and provisions to mount or attach an adjacent device.

The common waveguide of an OMT typically supports two orthogonal linearly polarized modes. Within this document, the terms "support" and "supporting" mean that a waveguide will allow propagation of a mode with little or no loss. The common waveguide terminates at a common port aperture. The common port aperture is defined by the intersection of the common waveguide and an exterior surface of the OMT.

Each of the two branching waveguides of an OMT typically support only a single linearly polarized mode. The mode supported by the first branching waveguides is orthogonal to the mode supported by the second branching waveguide. In a typical OMT, a first branching waveguide is axially aligned with the common waveguide. A second branching waveguide is typically normal to the common waveguide. Within this document, the term "orthogonal" will be reserved to describe the polarization direction of modes, and "normal" will be used to describe geometrically perpendicular structures.

The branching waveguide that is axially aligned with the common waveguide terminates at what is commonly called the vertical port. The linearly polarized mode supported by the vertical port is commonly called the vertical mode. The branching waveguide which is normal to the common waveguide is terminated at what is commonly called the horizontal port. The branching waveguide that terminates at the horizontal port also supports only a single polarized mode commonly called the horizontal mode.

The terms "horizontal" and "vertical" will be used in this document to denote the two orthogonal modes and the waveguides and ports supporting those modes. Note, however, that these terms do not connote any particular orientation of the modes or waveguides with respect to the physical horizontal and vertical directions.

An example prior art OMT is shown in FIG. 1A and FIG. 1B. FIG. 1A is a perspective view of the prior art OMT showing the common port, labeled PORT 1. The common port includes a common port aperture defined by the intersection of the common waveguide and the surface, or face, of the common port. The common port aperture may have a square, as shown, or circular cross section, or other shape that supports two orthogonal modes. In FIG. 1A, the common port aperture is centered in a circular flange with six holes for attaching the adjacent waveguide structure (not shown). The flange may be circular, square, rectangular or other shape. The flange may have more, fewer, or no attachment holes.

FIG. 1B is a different perspective view of the same prior art OMT device. PORT 2 is the vertical port that terminates the branching waveguide that is axially aligned with the common waveguide. PORT 2 includes a vertical port aperture at or near the center of a generally square mounting flange. PORT 3 is the horizontal port that terminates the branching waveguide that is normal to the common waveguide. PORT 3 includes a horizontal port aperture at or near the center of a generally square mounting flange. The horizontal port aperture and the vertical port aperture may be rectangular in cross-section, as shown, or may be elliptical or other shape that supports a single polarization mode. The cross-sectional shape of the horizontal port aperture and the vertical port aperture may be different. The mounting flanges of PORT 2 and PORT 3 may be square, round, or other shape. The mounting flanges may have more, fewer, or no attachment holes. The mounting flanges for PORT 2 and PORT 3 may be different.

An OMT is a versatile device that may be used in a variety of applications where two orthogonally polarized signals are simultaneously guided through the OMT. The OMT can be designed to support one frequency band, two distinctly different bands, or overlapping frequency bands by the appropriate design of the orthogonal branching waveguides. For example, a common application of the OMT is in X-band or Ku-band satellite communication systems where an OMT may be positioned behind a satellite reflector antenna. The OMT may simultaneously guide a vertically polarized transmitted signal from the vertical port to the antenna and guide a horizontally polarized received signal from the antenna to a receiver via the horizontal port.

DETAILED DESCRIPTION

Throughout this description, the embodiments and examples shown should be considered as exemplars, rather than limitations on the apparatus and methods disclosed or claimed. Features and structures retain the same reference designator in all figures where the feature or structure is visible. A reference designator that is not described in conjunction with a particular figure may be assumed to have the same function as described in conjunction with a preceding figure.

Description of Apparatus

Figure 1A:
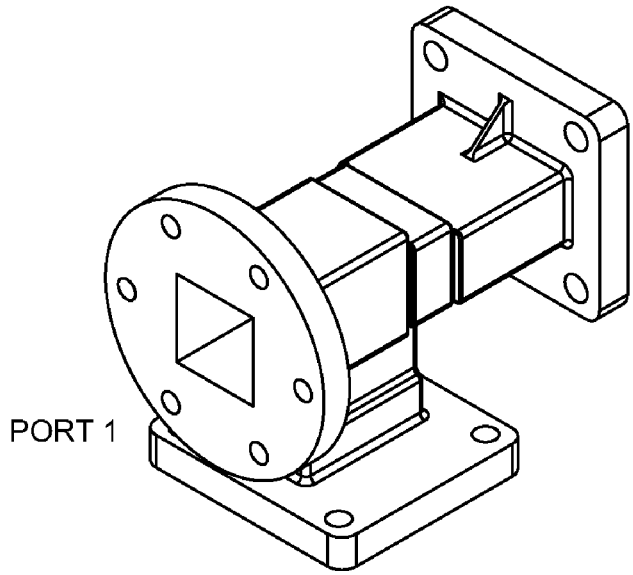
FIG. 1A PRIOR ART
FIG. 1A and FIG. 1B are perspective drawings of a prior art OMT.
Figure 1B:
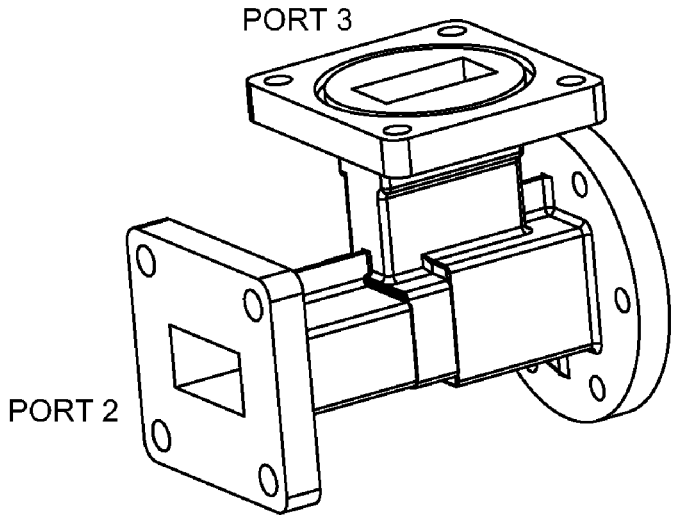
FIG. 1B PRIOR ART
Figure 2:
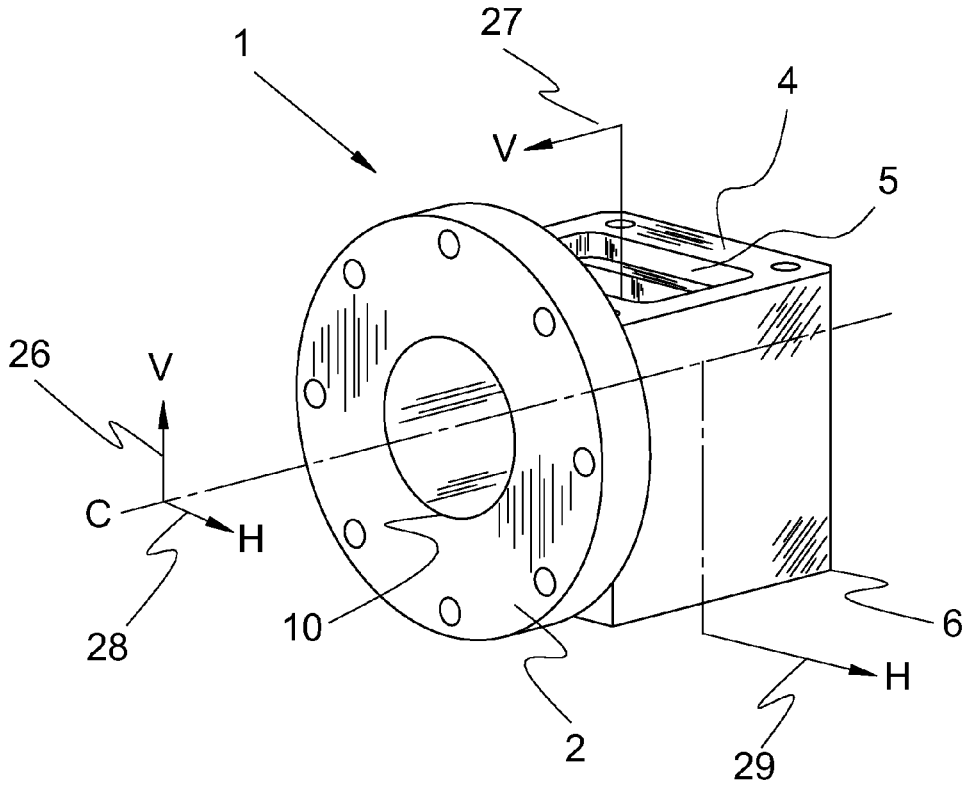
FIG. 2 is a perspective drawing of an exemplary OMT with opposing branch waveguides.

Referring now to FIG. 2, an OMT 1 may include a common waveguide 10 having an axis C. The common waveguide may terminate at a common port including a first flange 2 and a common port aperture. The first flange 2 may have an exterior surface, or face, that is essentially normal to the axis of the common waveguide 10. Within this document, the term "essentially" shall mean within reasonable manufacturing tolerances. The first flange 2 may be circular, as shown, square, rectangular, or other shape.

The common port aperture may be defined by the intersection of the common waveguide 10 and the face of the common port. The cross-section of the common waveguide 10 may be circular, as shown, square, or other shape suitable to support two orthogonal polarized modes. The common waveguide may support both a vertically polarized mode (V), as denoted by arrow 26, and a horizontally polarized mode (H), as denoted by arrow 28.

The OMT 1 may also include a vertical branching waveguide and a horizontal branching waveguide. The vertical branching waveguide may support a vertically polarized mode, and the horizontal branching waveguide may support a horizontally polarized mode orthogonal to the vertically polarized mode.

OMT 1 may have a vertical port including a second flange 4 having a vertical port aperture 5. The vertical port aperture 5 may be coupled to the vertical branching waveguide that supports a vertically polarized mode, as indicated by arrow 27. OMT 1 may also include a horizontal port including a third flange 6, which is not visible. The face of third flange 6 may be essentially parallel to the face of the second flange 4. The horizontal port may include a horizontal port aperture (not visible) coupled to the horizontal branching waveguide that supports a horizontally polarized mode as indicated by arrow 29. The vertical port and horizontal port may be positioned on opposing, or parallel but opposite, surfaces of the OMT.

Figure 3A:
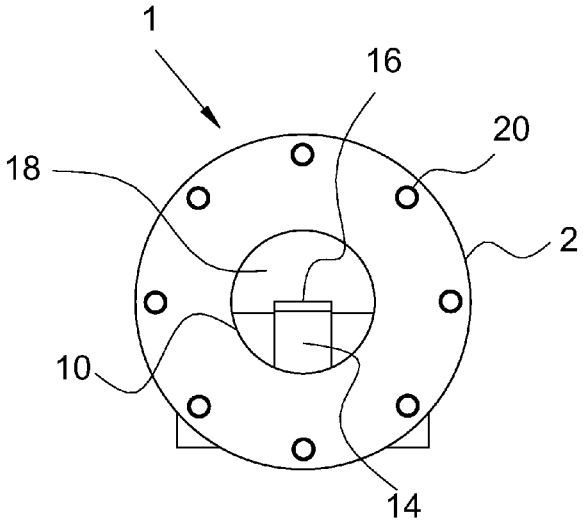
FIG. 3A is a front view of the ortho-mode transducer of FIG. 2.

FIG. 3A is a view of OMT 1 normal to the face of the first flange 2. The first flange 2 is shown having a series of holes 20 for attaching the OMT 1 to an adjacent waveguide structure (not shown). The holes 20 may be drilled thru the first flange 2 or may be tapped thru or blind holes. There may be more, fewer, or no attachment holes in the first flange 2. The first flange 2 may or may not be concentric with the end of common waveguide 10, which defines the common port. Looking into the common waveguide 10, sections of the structure 14, 16, and 18 of the branching waveguides may be seen. The structure of the branching waveguides will be described subsequently.

Figure 3B:
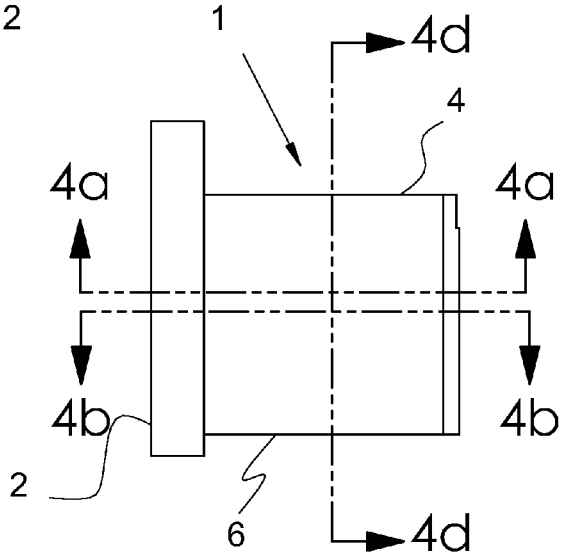
FIG. 3B is a side view of the ortho-mode transducer of FIG. 2.

FIG. 3B shows OMT 1 viewed parallel to the faces of the first flange 2, the second flange 4 and the third flange 6. FIG. 3B defines section planes 4*a*-4*a*, 4*b*-4*b*, and 4*d*-4*d* that will subsequently be used to describe the structure of the branching waveguides.

Figure 3C:
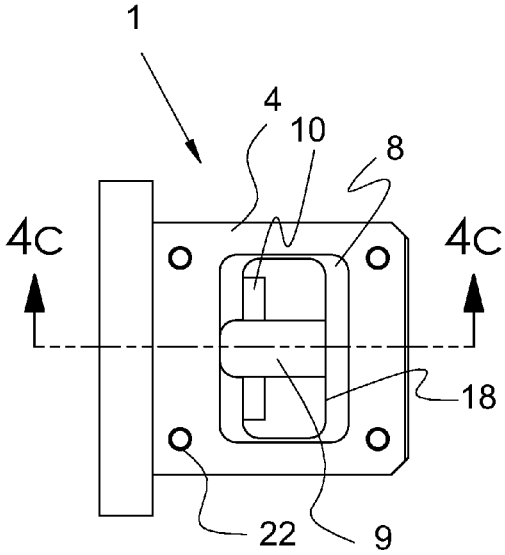
FIG. 3C is a top view of the ortho-mode transducer of FIG. 2.

FIG. 3C shows OMT 1 viewed normal to the face of the second flange 4. The face of the second flange 4 may be essentially square and have four threaded attachment holes 22, as shown. The face of the second flange 4 may conform to a standard for microwave waveguide flanges, such as a UG-51/U flange for a WR-112 waveguide. The face of the second flange 4 may have a shape other than square, and may have more, fewer, or no attachment holes.

As shown in FIG. 3C, the vertical port aperture, which is the external opening of a first section 8 of the vertical branching waveguide, is located on the face of the second flange 4. The vertical port aperture may be centered or asymmetrically positioned on the face of the second flange 4. Looking into the vertical port, the end views of a second section 9 of the vertical branching waveguide and a third section 18 of the vertical branching waveguide may be seen. The internal structure of the vertical branching waveguide will be described subsequently in additional detail.

Figure 3D:
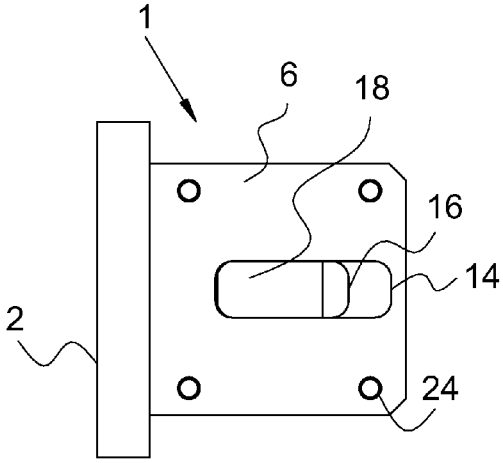
FIG. 3D is a bottom view of the ortho-mode transducer of FIG. 2.

FIG. 3D shows OMT 1 viewed normal to the face of the third flange 6. The face of the third flange 6 may be essentially square and have four threaded attachment holes 24, as shown. The face of the third flange 6 may conform to a standard for microwave waveguide flanges, such as a UG-51/U flange for a WR-112 waveguide. The face of the third flange 6 may have a shape other than square, and may have more, fewer, or no attachment holes.

As shown in FIG. 3D, the horizontal port aperture, which is the external opening of a first section 14 of the horizontal branching waveguide, is located on the face of the third flange 6. The horizontal port aperture may be centered or asymmetrically positioned on the face of the third flange 6. Looking into the horizontal port, the end views of a second section 16 of the horizontal branching waveguide and the third section 18 of the vertical branching waveguide may be seen. The internal structure of the horizontal and vertical branching waveguides will be described subsequently in additional detail.

Figure 4A:
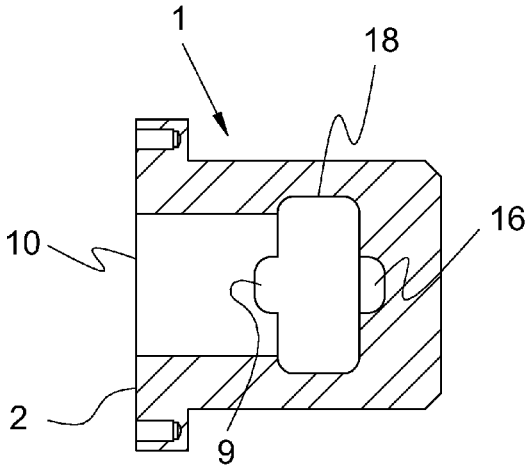
FIG. 4A is a cross-sectional view of cut-plane 4*a* in FIG. 3B.
Figure 4B:
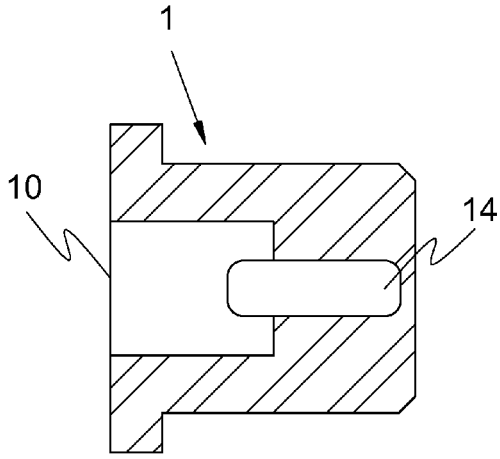
FIG. 4B is a cross-sectional view of cut-plane 4*b* in FIG. 3B.
Figure 4C:
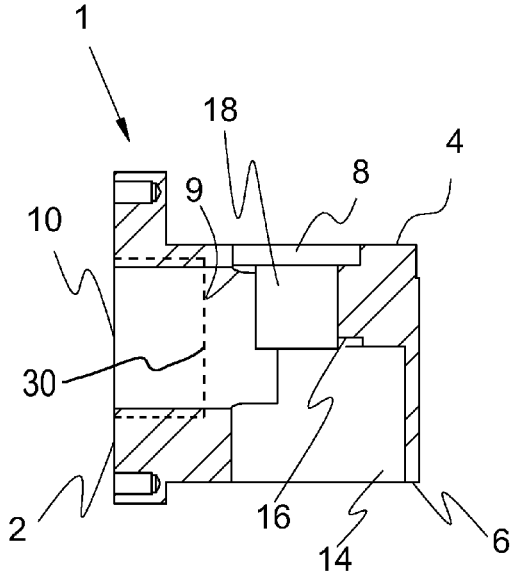
FIG. 4C is a cross-sectional view of cut-plane 4*c* in FIG. 3C.
Figure 4D:
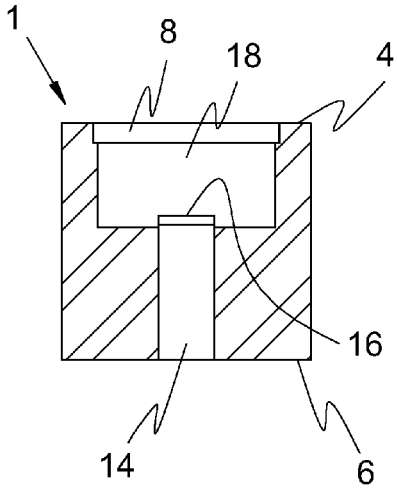
FIG. 4D is a cross-sectional view of cut-plane 4*d* in FIG. 3B.

FIG. 4A is a cross-sectional view of OMT 1 at section plane 4*a*-4*a* defined in FIG. 3B. FIG. 4B is a cross-sectional view of OMT 1 at section plane 4*b*-4*b* defined in FIG. 3B. FIG. 4C is a cross-sectional view of OMT 1 at section plane 4*c*-4*c* defined in FIG. 3C. Section plane 4*c*-4*c* is a symmetry plane that includes the axis of the common waveguide (C in FIG. 2), and the axis of the horizontal and vertical branching waveguides. The common waveguide and the vertical and horizontal branching waveguides may be symmetrical about the symmetry plane. Each of the waveguides may not be symmetrical about other planes. FIG. 4D is a cross-sectional view of OMT 1 at section plane 4*d*-4*d* defined in FIG. 3B.

Referring to FIG. 4C, the OMT 1 may include a common waveguide 10 that may be comprised of a single section having a constant cross-section, as shown. The common waveguide 10 may include two or more sections, as indicated by the dashed shape 30, in which case the section with the largest cross-sectional area may be adjacent the first flange 2. The cross-sectional area of the two or more sections may progressively decrease towards the center of the OMT.

The OMT 1 may include a vertical branching waveguide that may include a first section 8, a second section 9, and a third section 18. The cross-sectional shapes of the first section 8, the second section 9 and the third section 18 of the vertical branching waveguide may be different from each other and from the cross sectional shape of the common waveguide 10. The first, second, and third sections of the vertical branching waveguide may function as matching sections to couple the vertically polarized mode from the common waveguide to the vertical port aperture 5 in the second flange 4, while simultaneously rejecting the horizontally polarized mode. The term "rejecting" as used in this document means that the horizontally polarized mode is cut-off in the vertical branching waveguide such that power is not transferred from the common waveguide to the vertical port aperture.

The cross-sectional shapes and lengths of the first, second, and third sections of the vertical branching waveguide may be designed to minimize the return loss for a vertically polarized mode introduced via a standard waveguide (not shown) attached to the second flange 4. The cross-sectional shape of the first vertical branching waveguide section 8 may define the vertical port aperture in the second flange 4. The cross-sectional shape of the vertical port aperture may be different from, and not coaxial with, the cross-sectional shape of the standard waveguide to be attached to the second flange. The transition from the cross-sectional shape of the vertical port aperture and the cross-sectional shape of the attached standard waveguide may contribute to the matching function described in the prior paragraph.

The OMT 1 may include a horizontal branching waveguide that may include a first section 14 and a second section 16. The cross-sectional shapes of the first section 14 and the second section 16 of the horizontal branching waveguide may be different from each other and from the cross sectional shapes of the common waveguide 10 and the sections 8, 9, 18 of the vertical branching waveguide. The first and second sections of the horizontal branching waveguide 14 and 16 may function as matching sections to couple the horizontally polarized mode from the common waveguide to the horizontal port aperture in flange 6, while simultaneously rejecting the vertically polarized mode.

The cross-sectional shapes and lengths of the first and second sections of the horizontal branching waveguide may be designed to minimize the return loss for a horizontally polarized mode introduced via a standard waveguide (not shown) to be attached to the third flange 6. The cross-sectional shape of the first horizontal branching waveguide section 14 may define the horizontal port aperture in the third flange 6. The cross-sectional shape of the horizontal port aperture may be may be different from, and not concentric with, the cross-sectional shape of the standard waveguide to be attached to the horizontal port. The transition from the cross-sectional shape of the horizontal port aperture and the cross-sectional shape of the standard waveguide may contribute to the matching function.

The axis C (see FIG. 2) of the common waveguide and the axes of the horizontal and vertical branching waveguides may lie in a common symmetry plane. The axis of the vertical branching waveguide and the axis of the horizontal branching waveguide may be parallel but not necessarily coaxial. The cross-sectional shapes of the sections of the vertical and horizontal branching waveguides can be further understood by inspection of FIG. 4A, FIG. 4B, and FIG. 4D.

The OMT 1 of FIG. 2 thru FIG. 4D is a representative example designed to operate over a specific frequency bandwidth. The frequency bands for the vertical and horizontal branching waveguides may be the same, may be different and, if different, may overlap. Depending on the frequency and bandwidth requirements, the common waveguide and the vertical and horizontal branching waveguides may each comprise one section, two sections, three sections, or more sections. The number of sections in the common waveguide and the vertical and horizontal branching waveguides may be the same or different.

An OMT may be designed by using a commercial software package such as CST Microwave Studio. An initial model of the OMT may be generated with initial waveguide dimensions and relative positions that allow two orthogonal $TE_{11}$ modes to be supported in the common port waveguide 10, and that allow the horizontal and vertical branching waveguides to each support a single $TE_{10}$ mode, all between 7.25 GHz and 8.4 GHz. The structure may then be analyzed, and the reflection coefficients of the three ports may be determined. The dimensions of the model may be then be iterated manually or automatically to minimize the reflection coefficients of the dominant modes at each of the three ports.

Description of Fabrication Processes

An OMT, such as the OMT depicted in FIG. 2 through FIG. 4D, may be fabricated from a single block of metal in a series of machining steps. The fabrication of an OMT using only machining steps allows for low cost and highly reproducible performance.

Figure 5:
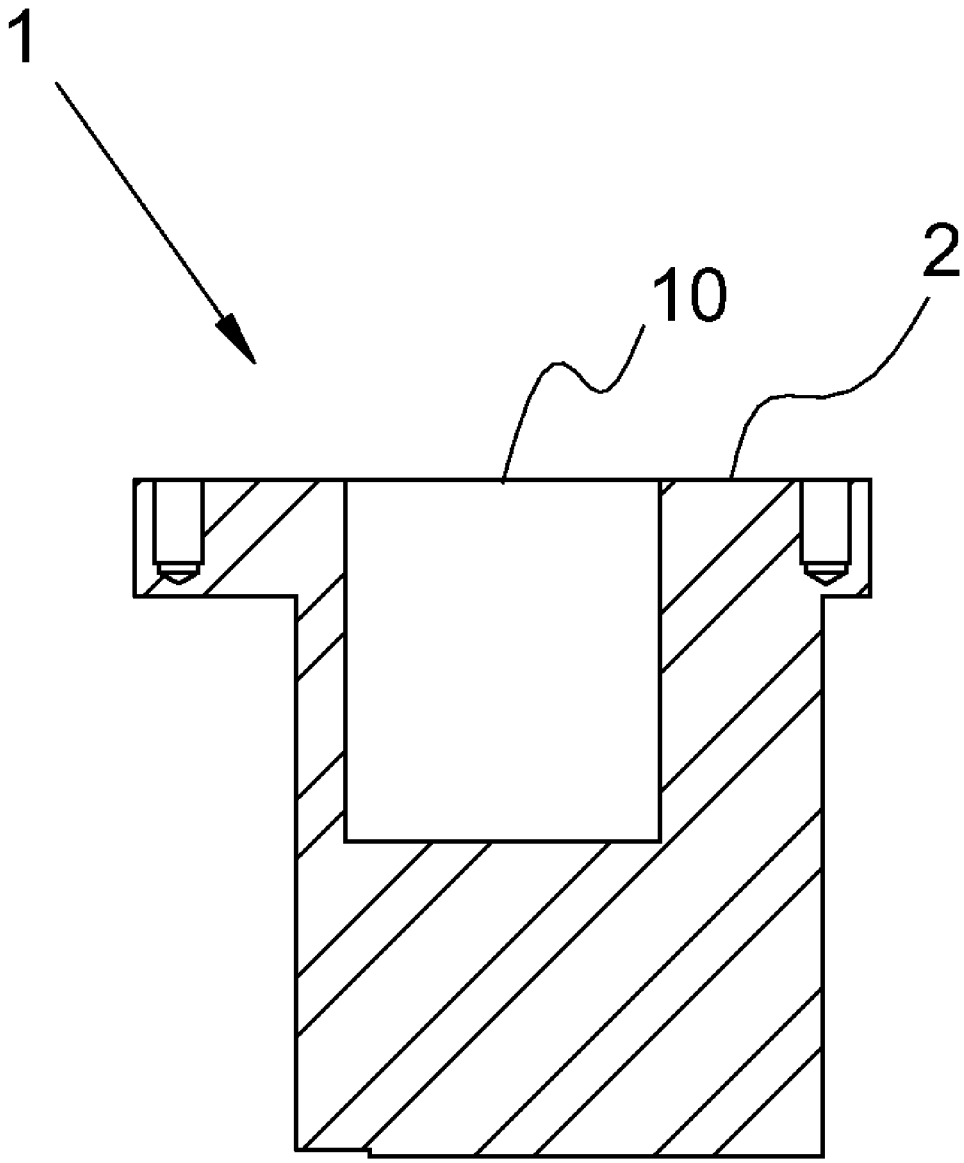
FIG. 5 is a cross-sectional view illustrating a machining operation.

As an example of the processes that may be used to fabricate an OMT, FIG. 5 shows a cross section of the OMT device 1 of FIG. 2 at the plane of symmetry. FIG. 5 illustrates a stage in the manufacturing process where the external surfaces including the flanges and attachment holes have been defined. Additionally, the common waveguide 10 has been formed by means of a milling or boring machining operation performed on the face of the common port 2.

Figure 6A:
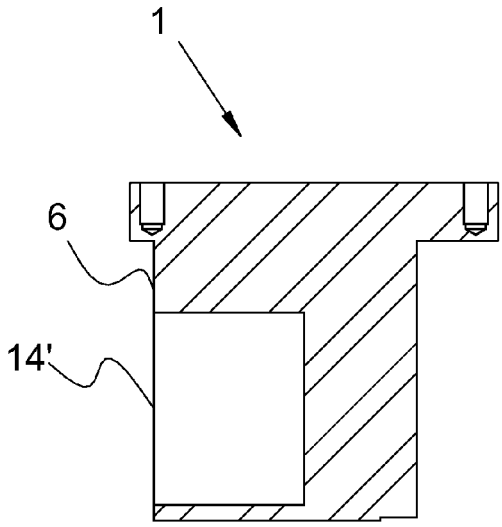
FIG. 6A-6C are cross-sectional views illustrating a series of machining operations.
Figure 6B:
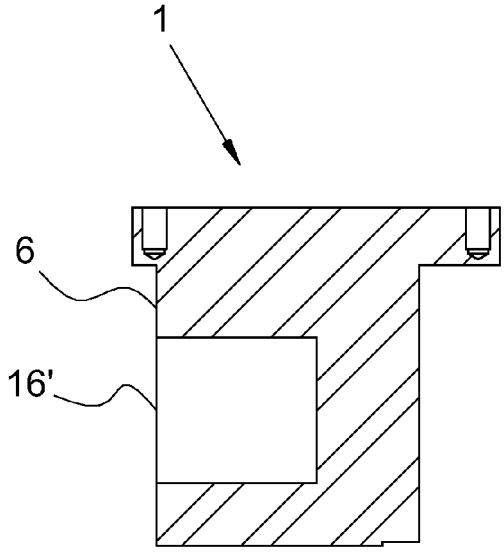
Figure 6C:
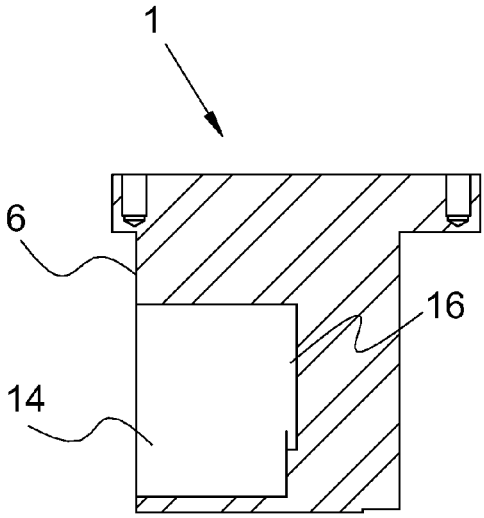

FIG. 6A and FIG. 6B illustrate two machining steps that may be used to form the two sections of the horizontal branching waveguide. Similar to FIG. 5, FIG. 6A illustrates a stage in the manufacturing process where the external surfaces including the flanges and attachment holes of OMT 1 have been defined. Additionally, a cavity 14' has been formed in the OMT 1 using a end-mill or other machining operation on the face of the horizontal port 6. Similarly, FIG. 6B shows a single cavity 16' formed in the OMT 1 using an end-mill or other machining operation. FIG. 6C shows the cumulative effect of the machining operations depicted in FIG. 6A and FIG. 6B. The first horizontal branching waveguide section 14 is defined by the cavity 14' and the second horizontal branching waveguide section 16 is defined by the difference between the cavity 14' and the cavity 16'. More correctly, the second horizontal branching waveguide section 16 is defined by the material removed in the machining step of FIG. 6B that was not already removed by the machining step of FIG. 6A. Note that the machining steps depicted in FIG. 6A and FIG. 6B can be performed in either order to produce the same result.

Figure 7A:
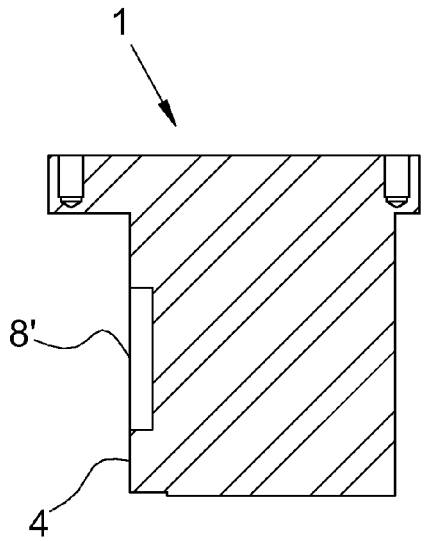
FIG. 7A-7D are cross-sectional views illustrating a series of machining operations.
Figure 7B:
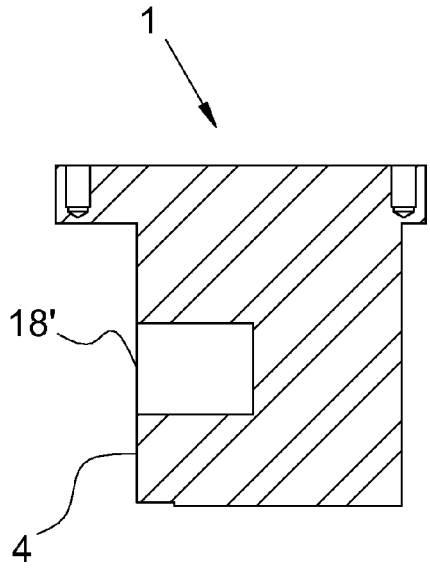
Figure 7C:
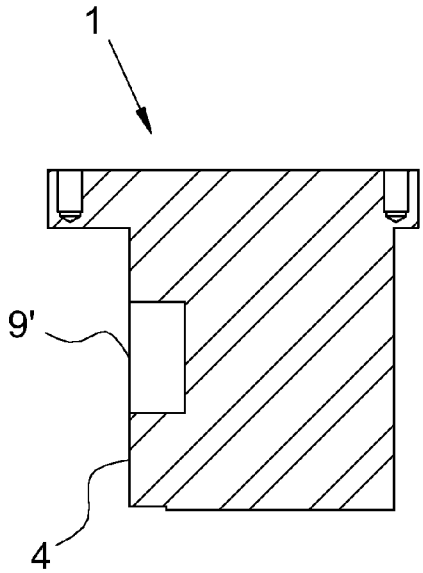
Figure 7D:
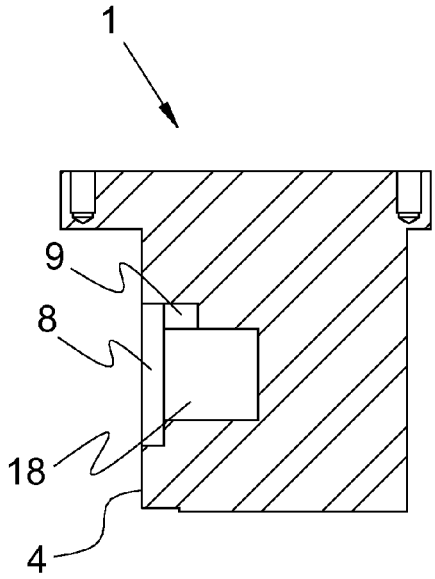

FIG. 7A, FIG. 7B, and FIG. 7C illustrate three machining steps that may be used to form the three sections of the vertical branching waveguide. Similar to FIG. 6A, FIG. 7A illustrates a stage in the manufacturing process where the external surfaces including the flanges and attachment holes have been defined. Additionally, a cavity 8' has been formed in the OMT 1 using an end-mill or other machining operation on the face of the vertical port 4. Similarly, FIGS. 7B and 7C show cavities 18' and 9' that may be formed in the OMT 1 using an end-mill or other machining operation. FIG. 7D shows the cumulative effect of the machining operations depicted in FIG. 7A, FIG. 7B, and FIG. 7C. The first vertical branching waveguide section 8 is defined by the cavity 8'. The second vertical branching waveguide section 9 is defined by the difference between the cavity 8' and the cavity 9'. The third vertical branching waveguide section 18 is defined by the difference between the cavity 18' and the cavities 8' and 9'. Note that the machining steps depicted in FIG. 7A, FIG. 7B, and FIG. 7C can be performed in any order to produce the same result.

The machining operations shown in the views of FIG. 5, FIG. 6A-B, and FIG. 7A-C can be performed in any sequence to cumulatively form the internal structure of the OMT 1.

An OMT, such as the OMT 1 of FIG. 2, may be designed such that the sections of the common waveguide and the vertical and horizontal branching waveguides having the largest cross-sectional areas are adjacent to the corresponding common, vertical or horizontal port. Additionally, the OMT may be designed such that the cross-sectional area of each succeeding waveguide segment is smaller than, and contained within, the cross-sectional area of the preceding waveguide segment. "Contained within" means that the entire perimeter of each succeeding waveguide section is visible through the aperture formed by the preceding waveguide section. With such a design, each waveguide section may be formed by machining through the aperture of the preceding waveguide section. Thus each waveguide section may be formed by a machining operation with an end mill or other machine tool, and the number of machining operation steps may be equal to the total number of waveguide segments.

The OMT of FIG. 2 and other OMT devices designed according to the same principles may be formed in a series of machining operations without assembly or joining operations such a soldering, brazing, bonding, or welding. Thus an OMT designed according to these principles may be formed from a single piece of material. The single piece may be initially a solid block of material. The OMT may be formed from a solid block of a conductive metal material such as aluminum or copper. The OMT may be also formed from a solid block of dielectric material, such as a plastic, which would then be coated with a conductive material, such as a metal film, after the machining operations were completed. If justified by the production quantity, a blank approximating the shape of the OMT could be formed prior the machining operations. The blank could be either metal or dielectric material and could be formed by a process such as casting or injection molding.

A specific example of an OMT as described herein is defined in Table I.

TABLE I

Ortho-mode Transducer for 7.25 GHz to 8.4 GHz

| Section | Reference designator | Cross-Section (2) | Depth (3) | Position (4) |
|---|---|---|---|---|
| Common waveguide | 10 | 1.070 diameter | 1.229 | n/a |
| Vertical branching waveguide | | | | |
| First cavity | 8' | 0.959 × 1.400 | 0.149 | 1.374 |
| Second cavity | 9' | 0.750 × 0.424 | 0.375 | 1.269 |
| Third cavity | 18' | 0.616 × 1.340 | 0.784 | 1.374 |
| Flange attachment holes | 22 | 1.474 × 1.352 | | 1.336 (6) |
| Horizontal branching waveguide | | | | |
| First cavity | 14' | 0.421 × 1.310 | 1.021 | 1.537 |
| Second cavity | 16' | 0.421 × 0.992 | 1.090 | 1.378 |
| Flange attachment holes | 24 | 1.352 × 1.474 | | 1.360 (6) |

(1) All dimensions in inches, ±0.002.

(2) Corners of rectangular cross-sections have internal radius of 0.125 inches.

(3) Measured from the face of the corresponding flange.

(4) The distance from the center of the waveguide section to the face of the first flange 2, measured along the axis of the common waveguide.

(5) The distance from the second flange 4 to the common waveguide axis C is 0.701. The distance from the third flange 6 to the axis C is 1.087.

(6) The distance from the center of the 4-hole pattern to the face of the first flange 2, measured along the axis of the common waveguide.

The performance of the exemplary OMT defined by Table I may be described in terms of the reflection coefficients at the three ports and the isolation between the vertically and horizontally polarized modes at the corresponding ports. The measured signal reflection coefficient for all ports of the OMT defined by Table I is less than −25 dB between 7.4 GHz to 8.32 GHz. The reflection coefficient rises to −20.2 dB at the band edges at 7.25 GHz and 8.4 GHz. The measured isolation between the vertically polarized and horizontally polarized signals is greater than 45 dB. This excellent isolation is due, at least in part, to the existence of the plane of symmetry defined by the common port axis C and the horizontal and vertical branching waveguide axes.

Closing Comments

The foregoing is merely illustrative and not limiting, having been presented by way of example only. Although examples have been shown and described, it will be apparent to those having ordinary skill in the art that changes, modifications, and/or alterations may be made.

Although many of the examples presented herein involve specific combinations of method acts or apparatus elements, it should be understood that those acts and those elements may be combined in other ways to accomplish the same objectives. With regard to the fabrication process, additional and fewer steps may be taken, and the steps as shown may be combined or further refined to achieve the methods described herein. Acts, elements and features discussed only in connection with one embodiment are not intended to be excluded from a similar role in other embodiments.

For means-plus-function limitations recited in the claims, the means are not intended to be limited to the means disclosed herein for performing the recited function, but are intended to cover in scope any means, known now or later developed, for performing the recited function.

As used herein, "plurality" means two or more.

As used herein, a "set" of items may include one or more of such items.

As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

As used herein, "and/or" means that the listed items are alternatives, but the alternatives also include any combination of the listed items.

It is claimed:

1. An ortho-mode transducer, comprising:

a first surface having a common port aperture a second surface a vertical port aperture, the second surface essentially normal to the first surface a third surface having a horizontal port aperture, the third surface essentially normal to the first surface and essentially parallel to the second surface a circular cylindrical common waveguide coupled to the common port aperture, the common waveguide having an essentially circular waveguide cross-section supporting orthogonal vertical and horizontal modes a vertical branching waveguide to couple the vertical mode between the vertical port aperture and the common waveguide while rejecting the horizontal mode a horizontal branching waveguide to couple the horizontal mode between the horizontal port aperture and the common waveguide while rejecting the vertical mode wherein the ortho-mode transducer is fabricated from a single piece.

2. The ortho-mode transducer of claim 1, wherein the common waveguide, the vertical branching waveguide, and the horizontal branching waveguide are all symmetrical about a common symmetry plane.

3. The ortho-mode transducer of claim 2, wherein an axis of the vertical branching waveguide and an axis of the horizontal branching waveguide are parallel.

4. The ortho-mode transducer of claim 1, wherein the single piece is a metal material.

5. The ortho-mode transducer of claim 1, wherein the single piece is a dielectric material.

6. The ortho-mode transducer of claim 1, wherein the horizontal branching waveguide comprises a plurality of horizontal branching waveguide sections, each horizontal branching waveguide section having a cross-sectional shape different from each other of the plurality of horizontal branching waveguide sections.

7. The ortho-mode transducer of claim 6, wherein a horizontal branching waveguide section of the plurality of horizontal branching waveguide sections having the largest cross-sectional shape is adjacent to the horizontal port aperture each successive horizontal branching waveguide section in the plurality of horizontal branching waveguide sections having a cross-sectional shape smaller than and contained within the cross-sectional shape of the preceding horizontal branching waveguide section.

8. The ortho-mode transducer of claim 1, wherein the vertical branching waveguide comprises a plurality of vertical branching waveguide sections, each vertical branching waveguide section having a cross-sectional shape different from each other of the plurality of vertical branching waveguide sections.

9. The ortho-mode transducer of claim 8, wherein a vertical branching waveguide section of the plurality of vertical branching waveguide sections having the largest cross-sectional shape is adjacent to the vertical port aperture each successive vertical branching waveguide section in the plurality of vertical branching waveguide sections having a cross-sectional shape smaller than and contained within the cross-sectional shape of the preceding vertical branching waveguide section.

10. The ortho-mode transducer of claim 1, wherein the common waveguide comprises a plurality of common waveguide sections, each common waveguide section having a cross-sectional shape different from each other of the plurality of common waveguide sections.

11. The ortho-mode transducer of claim 10, wherein a common waveguide section of the plurality of common waveguide sections having the largest cross-sectional shape is adjacent to the common port aperture each successive common waveguide section in the plurality of common waveguide sections having a cross-sectional shape smaller than and contained within the cross-sectional shape of the preceding common waveguide section.

12. The ortho-mode transducer of claim 1, wherein the first surface comprises a first flange.

13. The ortho-mode transducer of claim 1, wherein the second surface comprises a second flange.

14. The ortho-mode transducer of claim 1, wherein the third surface comprises a third flange.

15. A method of fabricating an ortho-mode transducer including a circular cylindrical common waveguide coupled to a vertical branching waveguide divided into three vertical branching waveguide sections and a horizontal branching waveguide divided into two horizontal branching waveguide sections, the method comprising forming the circular cylindrical common waveguide by a first machining operation which cuts a cylindrical cavity having an essentially circular waveguide cross-section into a first surface forming the vertical branching waveguide by three machining operations which cut successive cavities into a second surface normal to the first surface forming the horizontal branching waveguide by two machining operations which cut successive cavities into a third surface parallel to the second surface.

16. The method of fabricating an ortho-mode transducer of claim 15, further comprising forming a blank approximating the shape of the ortho-mode transducer prior to machining operations.

17. An ortho-mode transducer produced by the method of claim 15.

18. An ortho-mode transducer, comprising:

a first surface having an aperture defining a common port a second surface having an aperture defining a vertical port, the second surface essentially normal to the first surface a third surface having an aperture defining a horizontal port, the third surface essentially normal to the first surface and essentially parallel to the second surface a circular cylindrical common waveguide coupled to the common port, the common waveguide having an essentially circular waveguide cross-section supporting orthogonal vertical and horizontal modes a vertical branching waveguide to couple the vertical mode between the vertical port and the common waveguide while rejecting the horizontal mode, the vertical branching waveguide consisting of:

a first vertical branching waveguide section coupled to the vertical port a second vertical branching waveguide section between the first vertical branching waveguide section and a third vertical waveguide section, the second vertical branching waveguide section having a cross-section that is smaller than and contained within a cross section of the first vertical branching waveguide section a third vertical branching waveguide section between the second vertical branching waveguide section and the common waveguide, the third vertical branching waveguide section having a cross-section that is smaller than and contained within a cross section of the second vertical branching waveguide section a horizontal branching waveguide to couple the horizontal mode between the horizontal port and the common waveguide while rejecting the vertical mode, the horizontal branching waveguide consisting of:

a first horizontal branching waveguide section coupled to the horizontal port a second horizontal branching waveguide section between the first horizontal branching waveguide section and the common waveguide, the second horizontal branching waveguide section having a cross-section that is smaller than and contained within a cross section of the first horizontal branching waveguide section.

19. The ortho-mode transducer of claim 18, wherein the common waveguide, the vertical branching waveguide, and the horizontal branching waveguide are all symmetrical about a common symmetry plane.

20. The ortho-mode transducer of claim 19, wherein an axis of the vertical branching waveguide and an axis of the horizontal branching waveguide are parallel.

* * * * *